US008343018B2

(12) United States Patent
Moulton

(10) Patent No.: US 8,343,018 B2
(45) Date of Patent: Jan. 1, 2013

(54) MUSCLE TENSION STRAP

(76) Inventor: Kelly J. Moulton, Cottonwood, AZ (US)

( * ) Notice: Subject to any disclaimer, the term of this patent is extended or adjusted under 35 U.S.C. 154(b) by 1198 days.

(21) Appl. No.: 11/633,767

(22) Filed: Dec. 5, 2006

(65) Prior Publication Data

US 2008/0132392 A1 Jun. 5, 2008

(51) Int. Cl.
*A63B 21/002* (2006.01)
*A63B 21/00* (2006.01)

(52) U.S. Cl. ..... 482/91; 482/131; 482/907

(58) Field of Classification Search ..... 482/10, 482/11, 49, 91, 92, 95, 96, 121–126, 129–131, 482/139, 148, 907; 2/308, 311, 331, 338
See application file for complete search history.

(56) References Cited

U.S. PATENT DOCUMENTS 3,119,614 A * 1/1964 Berry ..... 482/91
3,966,204 A * 6/1976 Dubach ..... 482/93
4,220,328 A * 9/1980 Crush, Jr. ..... 482/92
5,254,065 A * 10/1993 Pollock ..... 482/129
5,411,461 A * 5/1995 Thomascik ..... 482/124
5,624,359 A * 4/1997 Dean ..... 482/91
6,368,255 B1 * 4/2002 Chan-Rouse ..... 482/91
6,450,930 B1 * 9/2002 Kroke ..... 482/121
6,840,894 B2 * 1/2005 Lerner ..... 482/124
2005/0227814 A1 * 10/2005 Takemura et al. ..... 482/44
2007/0066450 A1 * 3/2007 Hetrick ..... 482/91
2007/0173382 A1 * 7/2007 Axelrod ..... 482/91
2007/0265145 A1 * 11/2007 Teng ..... 482/91

* cited by examiner

*Primary Examiner* — Oren Ginsberg
(74) *Attorney, Agent, or Firm* — Parsons & Goltry; Robert A. Parsons; Michael W. Goltry

(57) ABSTRACT

A muscle tension strap including a pair of elongated flat bands each formed of substantially non-resilient material. The pair of flat bands are affixed together at a plurality of intermediate points therealong to form a plurality of tandem loops. The plurality of intermediate points at which the pair of elongated flat bands are affixed together are in a range of four to seven. Portions of each flat band adjacent each end are affixed together in overlying relationship to form a final loop with a handle therein and the pair of flat bands have a length in a range of five feet to seven feet.

8 Claims, 8 Drawing Sheets

MUSCLE TENSION STRAP

FIELD OF THE INVENTION

This invention generally relates to an exercise strap and more specifically to a strap for producing opposing tension in muscles of the body.

BACKGROUND OF THE INVENTION

In the present enthusiasm for exercise there is an equal search for more perfect exercise devices. In most cases these exercise devices become extremely complicated and expensive. Also, it is generally desirable to exercise various portions of the body using the same device. This desire results in exercise devices that are extremely large, unwieldy, and expensive. Further, because of the size, many of these machines require special storage and/or use areas. Because of the cost and space requirements, many people cannot afford such exercise devices and must either be satisfied with less useful or functional devices or must spend money in professional exercise rooms.

It would be highly advantageous, therefore, to remedy the foregoing and other deficiencies inherent in the prior art.

Accordingly, it is an object of the present invention to provide a new and improved muscle tension strap.

Another object of the invention is to provide a new and improved muscle tension strap that is simple and convenient to use.

Another object of the invention is to provide a new and improved muscle tension strap that is highly functional and versatile.

Another object of the invention is to provide a new and improved muscle tension strap that is inexpensive, small, and easily stored.

Another object of the invention is to provide a new and improved muscle tension strap that can be utilized effectively by persons of any size, sex, or age, as well as people with various physical limitations.

SUMMARY OF THE INVENTION

The above objects and others are realized in a muscle tension strap including a pair of elongated flat bands affixed together at a plurality of intermediate points to form a plurality of tandem loops and portions of each flat band adjacent each end are affixed together to form a final loop at each end. The muscle tension strap is preferably used by engaging a body part, such as a hand or foot, in a first loop of the muscle tension strap and another body part, such as another hand or foot, in a second loop of the muscle tension strap, wherein the first loop is spaced from the second loop. The user then applies tension to the first loop with the first body part and applies opposed tension to the second loop with the second body part to stress and exercise both the first and the second body parts and/or intermediate muscles.

The above objects and others are further achieved in a preferred embodiment wherein a muscle tension strap includes a pair of elongated flat bands each formed of substantially non-resilient material. The pair of flat bands are affixed together at a plurality of intermediate points therealong to form a plurality of tandem loops. The plurality of intermediate points at which the pair of elongated flat bands are affixed together are in a range of four to seven. Portions of each flat band adjacent each end are affixed together in overlying relationship to form a final loop with a handle therein and the pair of flat bands have a length in a range of five feet to seven feet.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
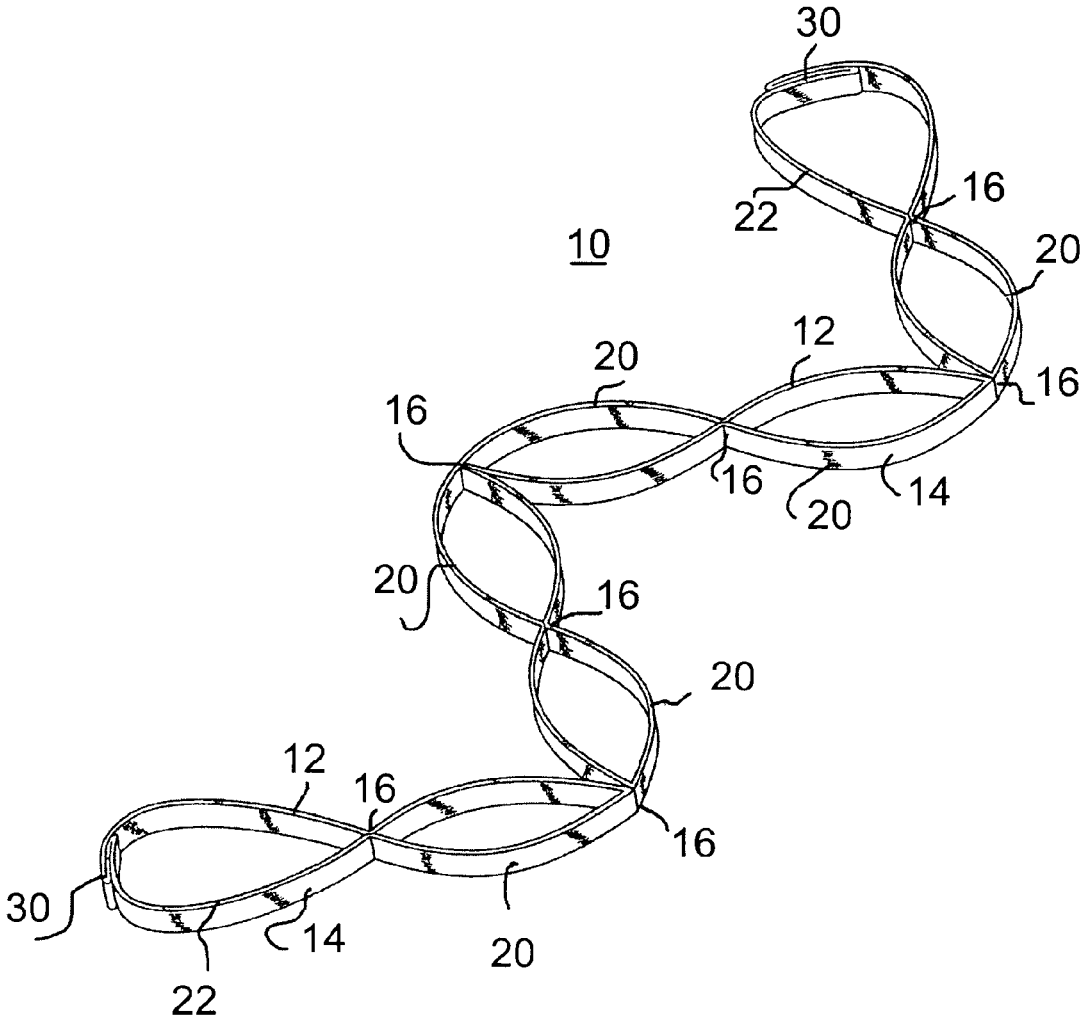
FIG. 1 is a view in perspective of a muscle tension strap in accordance with the present invention.
Figure 8:
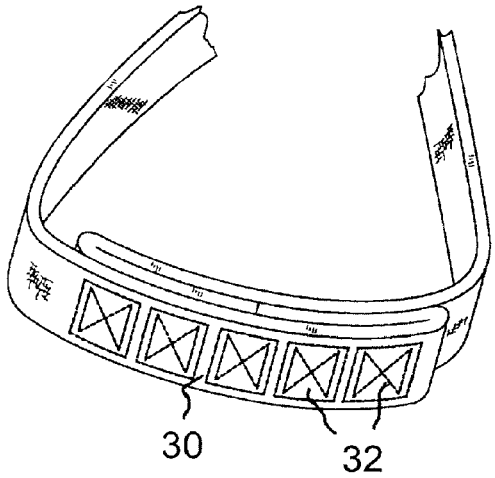
FIG. 8 is an enlarged view of one end of the muscle tension strap of FIG. 1.

Turning now to the drawings, attention is first directed to FIG. 1 which illustrates one embodiment of a muscle tension strap 10 in accordance with the present invention. Muscle tension strap 10 includes a pair of elongated bands or strips 12 and 14 affixed together at intermediate points 16, as illustrated in greater detail in FIG. 9, to form a plurality of loops 20 coupled in tandem so as to form an elongated chain of loops 20. In an end loop 22 at each end of the chain of loops, bands 12 and 14 are affixed in overlapped orientation, as illustrated in more detail in FIG. 8, to form a handle 30. It is anticipated that muscle tension strap 10 will preferably have a length in a range from five to seven feet.

While bands 12 and 14 are preferably formed of a flat flexible substantially non-resilient material, such as plastic, leather, or various multi-layer woven materials, they can be slightly or partially resilient if desired. Also, in a preferred embodiment, intermediate points 16 are formed by some relatively simple manufacturing technique, such as placing the flat bands 12 and 14 in juxtaposition and sewing, stapling, heat welding, gluing, etc. In this preferred embodiment the number of intermediate points 16 should be sufficient to provide a wide variety of potential exercises and is preferably in a range of five to seven points. Similarly, handles 30 are formed by overlying several layers of bands 12 and 14 and sewing, stapling, heat welding, gluing, etc. in a plurality of areas 32.

Figure 9:
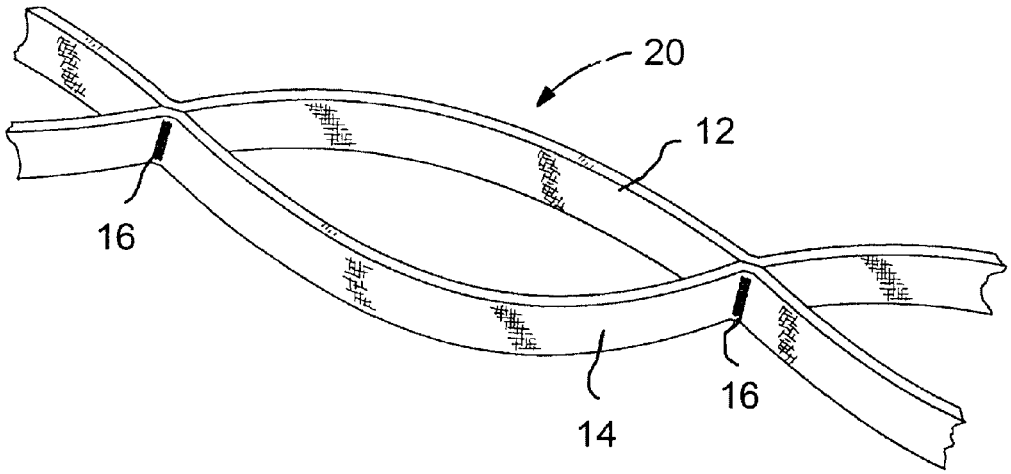
FIG. 9 is an enlarged view of a central loop of the muscle tension strap of FIG. 1.

As can be seen from FIG. 1 or 9, bands 12 and 14 are flat and approximately the same length so that the entire muscle tension strap 10 can be easily rolled into a small compact roll and stored in a drawer or other convenient place. Also, muscle tension strap 10 is formed of some convenient length that virtually any person of any size or strength can easily use it to perform a large variety of exercises.

Figure 2:
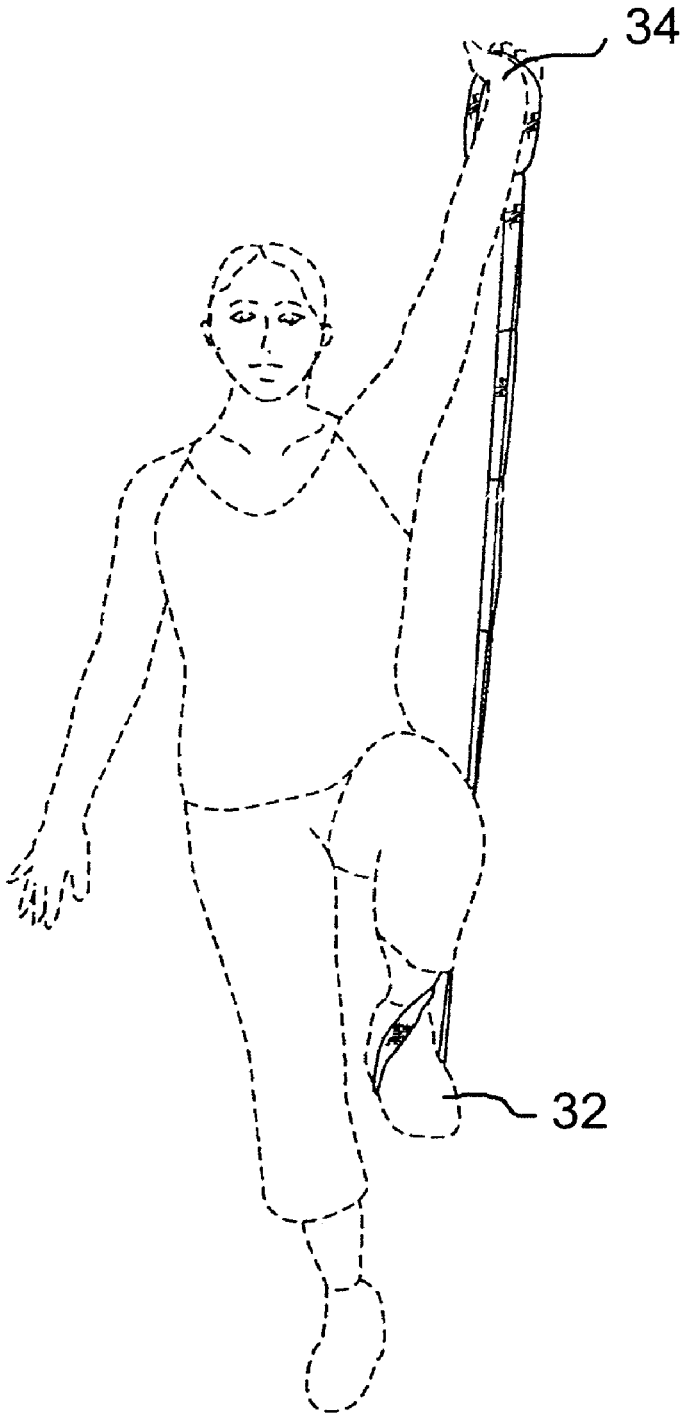
FIGS. 2-7 illustrate a variety of different uses for the muscle tension strap of FIG. 1.
Figure 3:
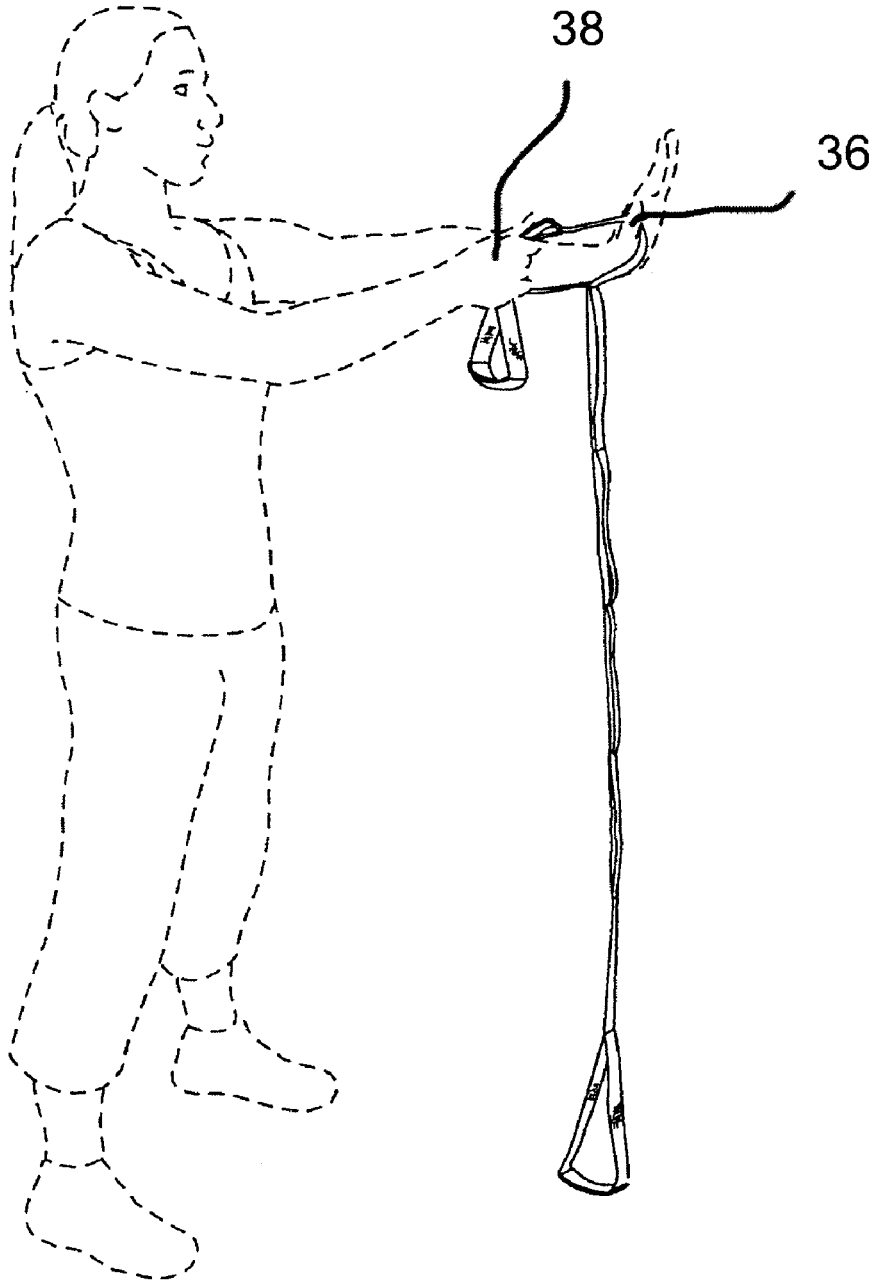

Some examples of exercises that can be performed by virtually any individual using muscle tension strap 10 are illustrated in FIGS. 2-7. In FIG. 2, for example, a foot 32 is placed on one handle 30 in end loop 22 and a hand 34 (on the same side of the body) grips the other handle in loop 22. The user or operator can then move the leg against the arm in opposed tension of the muscles, to provide a complete and useful exercise. In this fashion both legs and arms (left and right) can be thoroughly and effectively exercised. Clearly, any amount of stress desired in the arm and the leg can be used in the opposed tension exercise.

In FIG. 2 a hand and wrist exercise is illustrated in which, for example, a thumb 36 of one hand is extended through a loop 20 near one end of muscle tension strap 10 and handle 30 is grasped with the other hand 38. Opposed tension can then be applied to the hand and wrist with the thumb 36 extending through the intermediate loop 20 by holding the arm stiff and pulling with the other hand 38 and arm. Again, any amount of stress desired in the arm and the wrist can be used in the opposed tension exercise without the requirement of adding weights or changing devices.

Figure 4:
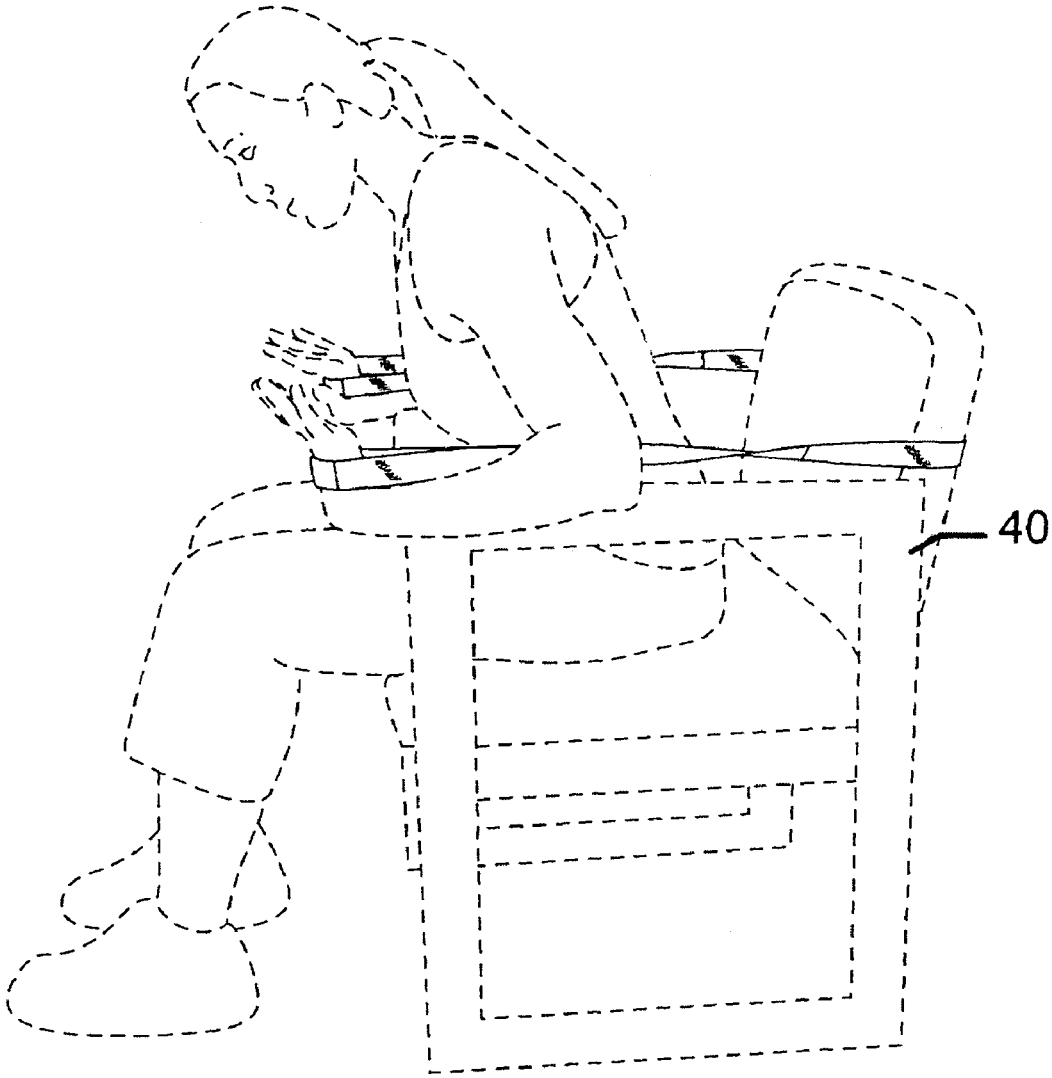
Figure 6:
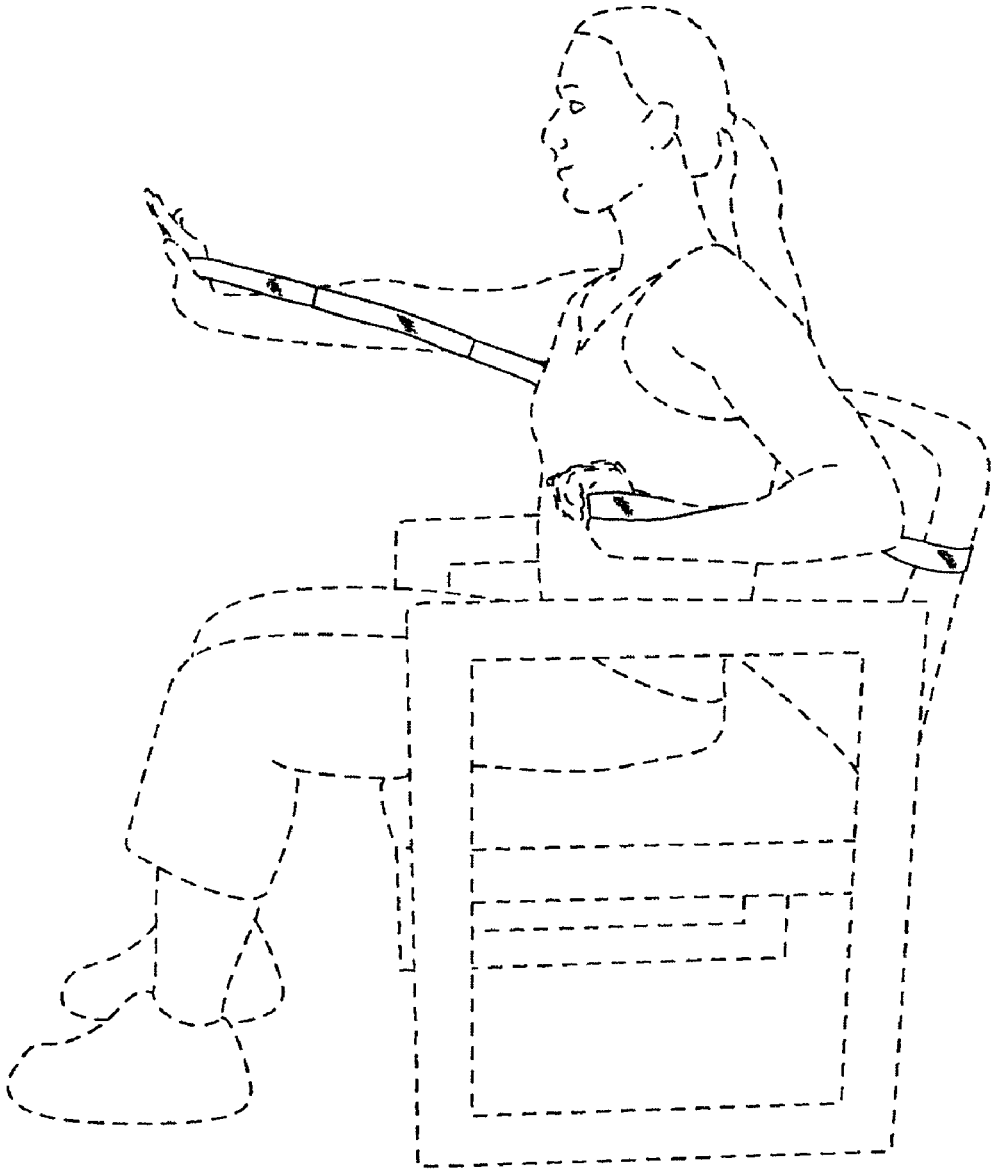

In FIG. 4, muscle tension strap 10 is extended around the back of a chair 40 and a handle 30 at each end of muscle tension strap 10 is grasped with the left and right hands, respectively. In this exercise muscle tension strap 10 is free to slide around the back of chair 40 and any desired amount of opposed stress can be applied through the left and right arms. Referring additionally to FIG. 6, it can be seen that different muscles in the arms and shoulders can be exercised by simply changing the direction of applying the tension. Again no additional weights or different devices are required to apply any desired amount of stress to the arms. As one arm is stressed, the other arm is stressed an equal amount so that both arms are stressed or exercised equally.

Figure 5:
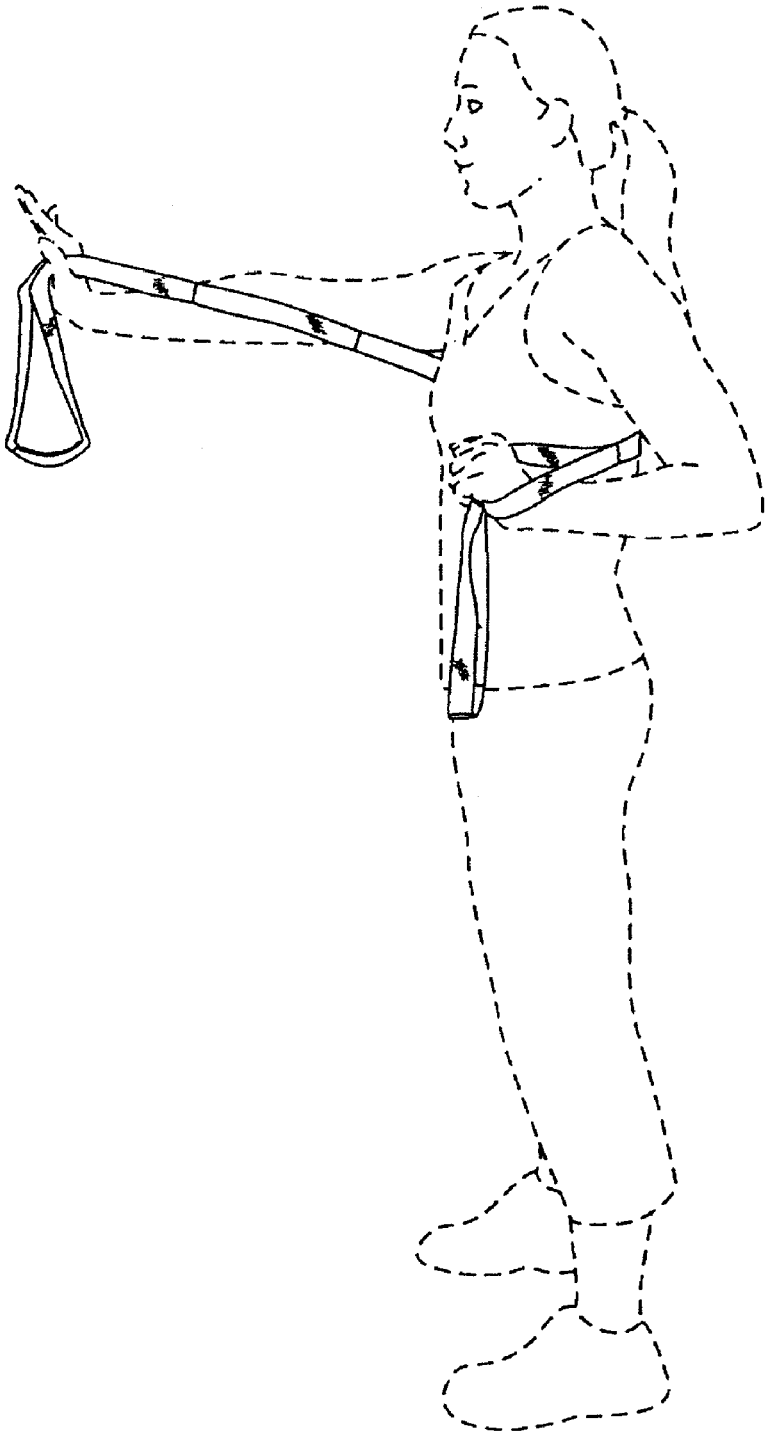

Referring to FIG. 5, a somewhat similar exercise is illustrated but muscle tension strap 10 simply extends around the back of the individual doing the exercise. Also, in this instance the individual has a hand engaged through an intermediate loop 20 adjacent each end. This illustrates the fact that any individual, regardless of size, can conveniently use muscle tension strap 10. This exercise will not produce undue friction on the back since in opposed stress exercises movement is not necessary. The main object is simply to stress the muscle of one arm against the muscle of the other arm with as much tension as desired.

Figure 7:
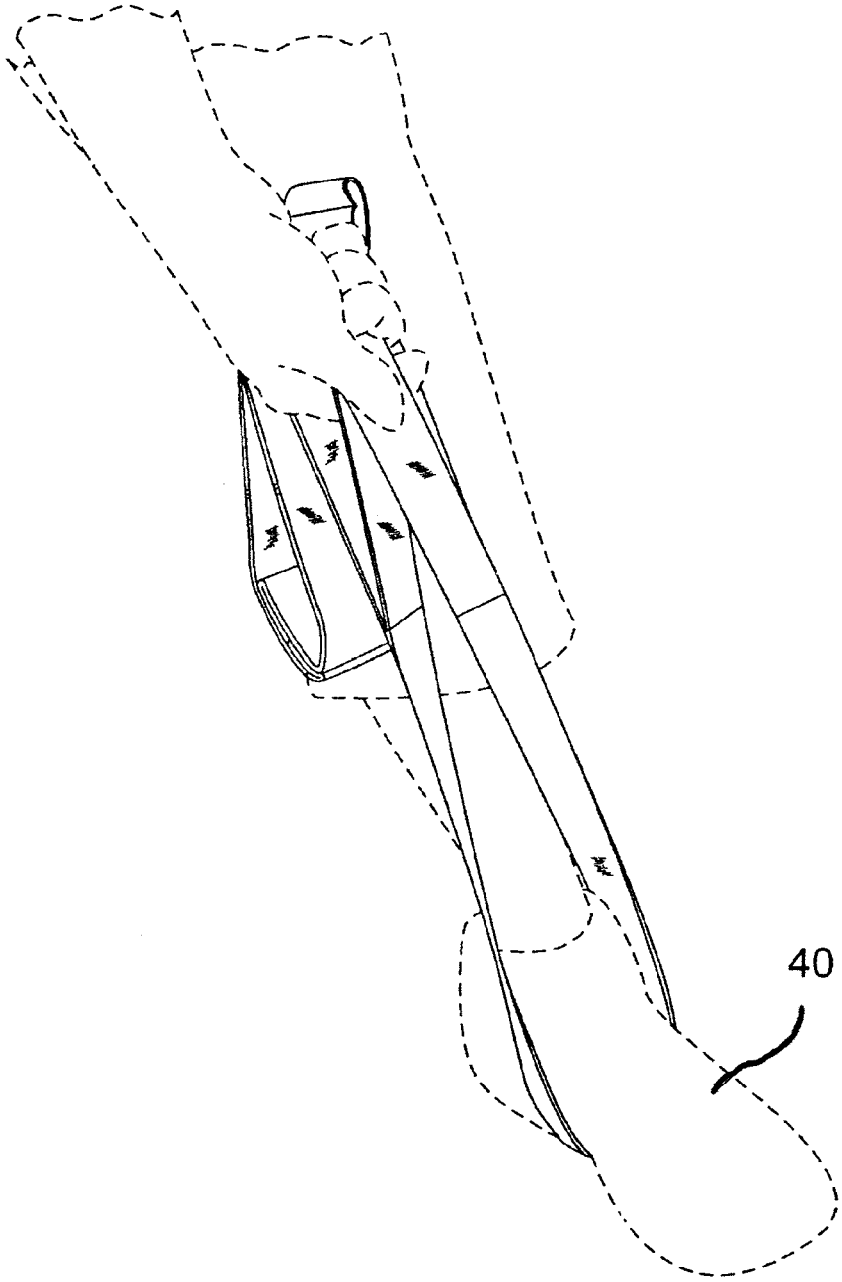

Another exercise is illustrated in FIG. 7 wherein one foot 40 is either placed through a loop 20 or end loop 22 and muscle tension strap 10 is grasped at a short distance from foot 40 to provide opposed tension in the foot, ankle or leg muscles.

It can be seen that any number of opposed tension exercises can be devised using muscle tension strap 10 to exercise every muscle in the body. Further, because opposed tension is used, rather than different weights and pulleys, the exercise can be as strenuous as desired and can be continuously extended or expanded to increase the amount of stress and, thus, the amount of exercise without changing muscle tension strap 10.

Thus, a new and improved muscle tension strap has been disclosed that is simple and convenient to use. Further, the muscle tension strap is highly functional and versatile. Also, because the muscle tension strap is formed of flat material it is inexpensive, small, and easily stored. It is important that the new and improved muscle tension strap can be utilized effectively by persons of any size, sex, or age, as well as people with various physical limitations, and does not require constant updating and changing as the user gains in strength.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A muscle tension strap comprising:

a pair of elongated flat bands affixed together at a plurality of intermediate points to form a plurality of tandem loops; and portions of each flat band adjacent each end affixed together to form a final loop at each end, wherein the number of intermediate points at which the pair of elongated flat bands are affixed together is in a range of four to seven.

2. A muscle tension strap as claimed in claim 1 wherein the pair of elongated flat bands are each formed of substantially non-resilient material.

3. A muscle tension strap as claimed in claim 1 wherein portions of each flat band adjacent each end are affixed together in overlying relationship to form the final loop with a handle therein.

4. A muscle tension strap as claimed in claim 1 wherein the pair of elongated flat bands have a length in a range of five feet to seven feet.

5. A muscle tension strap as claimed in claim 1 wherein the pair of elongated flat bands are affixed together at the plurality of intermediate points by sewing.

6. A muscle tension strap comprising:

a pair of elongated flat bands each formed of substantially non-resilient material, the pair of flat bands being affixed together at a plurality of intermediate points to form a plurality of tandem loops, the plurality of intermediate points at which the pair of elongated flat bands are affixed together being in a range of four to seven; and portions of each flat band adjacent each end being affixed together in overlying relationship to form a final loop with a handle therein, the pair of flat bands having a length in a range of five feet to seven feet.

7. A method of exercising comprising the steps of:

providing a muscle tension strap including a pair of elongated flat bands affixed together at a plurality of intermediate points to form a plurality of tandem loops and portions of each flat band adjacent each end affixed together to form a final loop at each end, wherein the number of intermediate points at which the pair of elongated flat bands are affixed together is in a range of four to seven;

engaging a body part in a first loop of the muscle tension strap and another body part in a second loop of the muscle tension strap, the first loop being spaced from the second loop; and applying tension to the first loop with the first body part and applying opposed tension to the second loop with the second body part to stress and exercise both the first and the second body parts.

8. A method as claimed in claim 7 wherein the body parts are each one of a left hand, a right hand, a left foot, and a right foot.

* * * * *